US008596742B2

(12) United States Patent
Leoni et al.

(10) Patent No.: US 8,596,742 B2
(45) Date of Patent: Dec. 3, 2013

(54) INKJET PRINTHEAD AND PRINTING SYSTEM WITH BOUNDARY LAYER CONTROL

(75) Inventors: Napoleon J. Leoni, San Jose, CA (US); Omer Gila, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 407 days.

(21) Appl. No.: 12/694,155

(22) Filed: Jan. 26, 2010

(65) Prior Publication Data

US 2011/0181639 A1 Jul. 28, 2011

(51) Int. Cl.
*B41J 29/38* (2006.01)

(52) U.S. Cl.
USPC ..... 347/16

(58) Field of Classification Search
USPC ..... 347/16, 37, 104
See application file for complete search history.

(56) References Cited

U.S. PATENT DOCUMENTS

| | | | | |
|---|---|---|---|---|
| 5,099,256 | A * | 3/1992 | Anderson | 347/103 |
| 5,923,343 | A | 7/1999 | Brosseau et al. | |
| 6,203,152 | B1 | 3/2001 | Boleda et al. | |
| 6,340,225 | B1 | 1/2002 | Szlucha | |
| 6,390,618 | B1 | 5/2002 | Wotton et al. | |
| 6,435,648 | B1 * | 8/2002 | Murakami et al. | 347/29 |
| 6,554,389 | B1 * | 4/2003 | Hawkins et al. | 347/19 |
| 6,561,620 | B2 * | 5/2003 | Pietrzyk et al. | 347/34 |
| 6,565,182 | B1 * | 5/2003 | Fredrickson et al. | 347/20 |
| 6,572,222 | B2 | 6/2003 | Hawkins et al. | |
| 6,631,966 | B2 * | 10/2003 | Watanabe et al. | 347/18 |
| 6,857,720 | B2 * | 2/2005 | Koller et al. | 347/22 |
| 6,863,393 | B2 | 3/2005 | Patterson et al. | |
| 6,981,766 | B2 | 1/2006 | Tsuji | |
| 7,044,582 | B2 | 5/2006 | Fredrickson et al. | |
| 7,458,677 | B2 | 12/2008 | Morris et al. | |
| 7,726,775 | B2 * | 6/2010 | Maeda | 347/37 |
| 2006/0109331 | A1 * | 5/2006 | Hasegawa | 347/108 |
| 2009/0195598 | A1 | 8/2009 | Silverbrook | |
| 2011/0304868 | A1 * | 12/2011 | Ohnishi | 358/1.9 |

FOREIGN PATENT DOCUMENTS

| | | | | |
|---|---|---|---|---|
| JP | 9-39256 | * | 2/1997 | B41J 2/135 |
| JP | 11-1001 | * | 1/1999 | B41J 2/16 |
| JP | 2000-108330 | * | 4/2000 | B41J 2/01 |
| JP | 2001-138548 | * | 5/2001 | B41J 2/18 |
| JP | 2010-214848 | * | 9/2010 | B41J 2/01 |
| WO | WO2009081110 A1 | | 7/2009 | |

* cited by examiner

*Primary Examiner* — Julian Huffman

(57) ABSTRACT

An inkjet printhead, printing system and a method of inkjet printing employ a boundary layer control apparatus to control a boundary layer of air flow surrounding a nozzle opening of an inkjet pen. The printhead includes the pen supported by a housing that is configured so that the nozzle opening both faces a substrate and is spaced from the substrate by a gap. The apparatus is a structure adjacent to the nozzle opening and supported at a leading edge of the housing ahead of the nozzle opening relative to a direction of movement of the substrate. The structure is configured to extend into the gap. The printing system further includes the substrate. The method includes moving the substrate below the printhead, controlling the boundary layer, and depositing an ink onto the moving substrate.

17 Claims, 4 Drawing Sheets

INKJET PRINTHEAD AND PRINTING SYSTEM WITH BOUNDARY LAYER CONTROL

CROSS-REFERENCE TO RELATED APPLICATIONS

N/A

STATEMENT REGARDING FEDERALLY SPONSORED RESEARCH OR DEVELOPMENT

N/A

BACKGROUND

Inkjet printing is widely used to form images on print media, such as paper, plastic and other media Inkjet printers are used in homes, small businesses and large businesses alike and provide excellent quality printing at relatively low cost. For manufacturers of inkjet printers, ink and even the print media, there is always a desire to make the printing process faster (e.g., increasing the number of pages per minute produced) without compromising print quality. Moreover, there is a desire to print on a variety of print media, including various plastics, in order to provide package labeling, for example. Some high speed commercial digital printers typically employ an offset printing technique where an image is formed on an intermediate substrate and then is transferred to a print media. Other commercial digital printers print directly on the print media. However, there are certain physical limitations that hinder how fast a high speed printer can work and still provide excellent print quality. These physical limitations may be found in the ink, or more particularly, in how the ink behaves in the printing environment. Other physical limitations may be found in the print media and the printing process itself.

During an inkjet printing process, the ink is exposed to certain aerodynamic drag forces and shear forces that tend to break up an ink droplet after it is released by the inkjet printhead but before it reaches an imaging substrate. In high speed, single pass inkjet printing systems for example, the aerodynamic drag forces and shear forces are high. The ink droplets are subject to being broken into satellites and aerosols by these forces which impact print quality. Nevertheless, manufacturers strive to create faster inkjet printing systems to accommodate a variety of consumers and their applications. Unfortunately, the faster the printing process the greater the forces to which the ink is subjected.

BRIEF DESCRIPTION OF THE DRAWINGS

The various features of embodiments of the present invention may be more readily understood with reference to the following detailed description taken in conjunction with the accompanying drawings, where like reference numerals designate like structural elements, and in which.

Figure 1A:
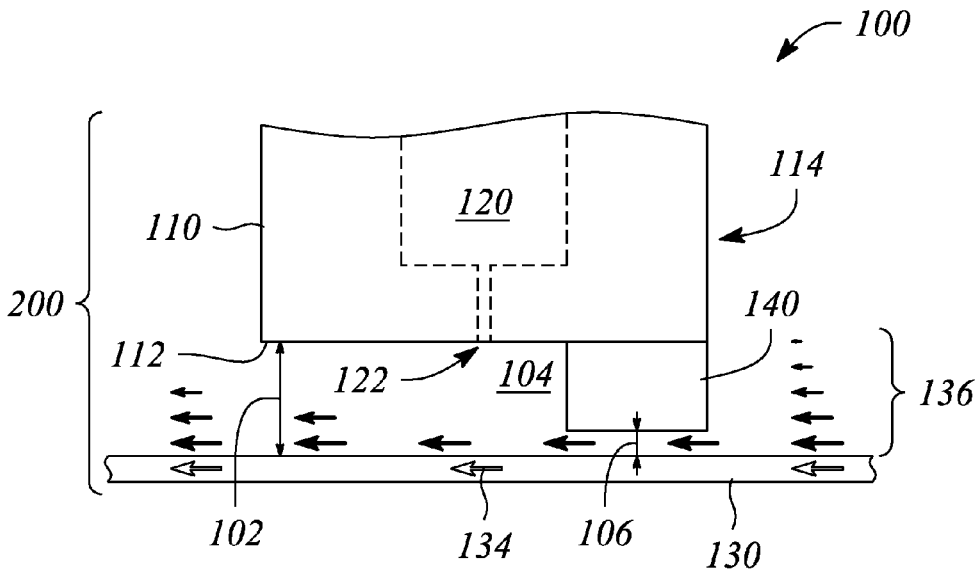
FIG. 1A illustrates a side view of an inkjet printhead having a boundary layer control apparatus of an inkjet printing system, according to an embodiment of the present invention.

Certain embodiments of the present invention have other features that are one of in addition to and in lieu of the features illustrated in the above-referenced figures. These and other features of the invention are detailed below with reference to the preceding drawings.

DETAILED DESCRIPTION

Embodiments of the present invention address print quality from an inkjet printer. In particular, the embodiments of the present invention are configured to control a boundary layer of air flow in a gap between an inkjet printhead and a moving imaging substrate. The boundary layer produces aerodynamic drag forces and shear forces in the gap that adversely effect ink droplets that traverse the gap in a droplet path from a nozzle opening in the inkjet printhead to the imaging substrate. For high speed, single pass inkjet printing systems, these forces are even stronger. Embodiments of the present invention provide an inkjet printhead, an inkjet printing system, and a method of inkjet printing that employ a boundary layer control apparatus to disrupt the boundary layer in a vicinity of the droplet path between the inkjet printhead and the imaging substrate. Disruption of the boundary layer reduces one or both of the aerodynamic drag forces and the shear forces produced by the boundary layer in the gap. In some embodiments, these forces may be minimized in the vicinity of the droplet path. A reduction in these forces in turn reduces the adverse effects on ink droplets that traverse the gap to reach the moving substrate. Some embodiments of the present invention are configured to substantially stagnate the air surrounding at least a portion of the droplet path between the inkjet pen and an imaging substrate.

In some embodiments, the boundary layer control apparatus diverts at least a portion of the boundary layer away from the gap. In some embodiments, the boundary layer is diverted from at least a portion of the droplet path in the gap. In some embodiments, the 'portion' of either the boundary layer or the droplet path is the entire layer or path, respectively. In some embodiments, the diversion may create a low pressure zone in the gap surrounding the nozzle opening. In some embodiments, the boundary layer is substantially blocked from the gap at a leading edge of the inkjet printhead. Blocking the boundary layer substantially mitigates any effect that the boundary layer may have had on the ink droplet. In particular, the air is or may be rendered substantially stagnant for at least a portion of the droplet path from the nozzle opening, according to the various embodiments herein.

As used herein, the article 'a' is intended to have its ordinary meaning in the patent arts, namely 'one or more'. For example, 'an element' means one or more elements and as such, 'the element' explicitly means 'the element(s)' herein. Also, any reference herein to 'top', 'bottom', 'upper', 'lower', 'up', 'down', 'front', back', 'left' or 'right' is not intended to be a limitation herein. Herein, the term 'about' when applied to a value generally means plus or minus 10% unless otherwise expressly specified. Moreover, examples herein are intended to be illustrative only and are presented for discussion purposes and not by way of limitation.

FIG. 1A illustrates a side view of an inkjet printhead 100 having a boundary layer control apparatus of an inkjet printing system 200 according to an embodiment of the present invention. The inkjet printhead 100 in FIG. 1A and in FIGS. 1B, 2A, 2B and 3 is magnified and not to scale. The inkjet printhead 100 comprises an inkjet pen 120 supported by a housing 110. The inkjet pen has a nozzle opening 122 in a side 112 of the housing 110 and is configured such that the nozzle opening 122 faces an imaging substrate 130 and is spaced from the imaging substrate 130 by a gap 102.

In various embodiments, the gap 102 may range from about 0.1 millimeter (mm) to about 5 mm and depends in part on the speed of the imaging substrate 130 during the printing process and the dimensional stability of the imaging substrate 130. For relatively stable substrates, the gap may be narrower than for dimensional unstable substrates. In some embodiments, the gap 102 ranges from about 0.5 mm to about 2 mm. In some embodiments, the gap 102 is about 1 mm. In some embodiments, the gap 102 may be about 1 mm and the speed of the imaging substrate may be about 2 m/s to about 10 m/s.

The inkjet printhead 100 further comprises a boundary layer control apparatus 140 adjacent to but laterally spaced from the nozzle opening 122 of the inkjet pen 120. The apparatus is a structure 140 supported at or near a leading edge 114 of the housing 110. The leading edge 114 of the housing 110 is defined as the housing edge that is ahead of the nozzle opening 122 relative to a direction of movement of the imaging substrate 130 (illustrated by arrows labeled 134 in the figures). The laterally spacing of the structure 140 relative to the nozzle opening 122 influences a thickness of the boundary layer 136 in the gap 102 in a vicinity of a droplet path from the nozzle opening 122. In general, the boundary layer thickness is proportional to the square root of the spacing between the nozzle opening 122 and the structure 140 and is inversely proportional to the square root of the speed of the moving substrate 130, for example. Hence, the smaller the spacing between the structure 140 and the nozzle opening 122 at a given substrate speed, the thinner the boundary layer 136 may be in the gap 102 in the vicinity of an ink droplet from the nozzle opening 122. As such, the structure 140 is positioned as close as is practical to the nozzle opening 122 considering the size or width of the inkjet printhead housing 110, the embodiment of the structure 140 and the speed of the moving substrate 130, for example. In some embodiments, a trailing end of the structure 140 (i.e., end closest to the nozzle opening 122) may be laterally spaced from the nozzle opening 122 a distance ranging from about 0.1 millimeters (mm) to about 5.0 mm, for example. In some embodiments, the trailing end of the structure 140 is about 1 mm to about 2 mm from the nozzle opening 122.

The boundary layer control structure 140 is configured to extend into the gap 102 for a distance adjacent to the leading edge of the housing to control the boundary layer of air flow (depicted by a plurality of arrows 136 in the figures). As such, the boundary layer 136 is disrupted and the air flow surrounding the nozzle opening 122 behind the boundary layer control apparatus 140 may be substantially stagnant. In particular, the boundary layer 136 is reduced in a vicinity of the nozzle opening 122 that includes at least a portion of a droplet path from the nozzle opening 122 to the imaging substrate 130. As a result, the vicinity includes a relatively low pressure zone 104 at least in an area between the nozzle opening 122 and a trailing end of the boundary layer control structure 140 compared to an area in front of the structure 140. Depending on the embodiment of the structure 140 for controlling the boundary layer, the boundary layer may gradually increase in thickness in the gap 102 with lateral distance from the trailing end of the structure 140 (e.g., downstream of the nozzle opening 122) or may be substantially prevented from growing in the gap 102 surrounding the nozzle opening 122.

Figure 1B:
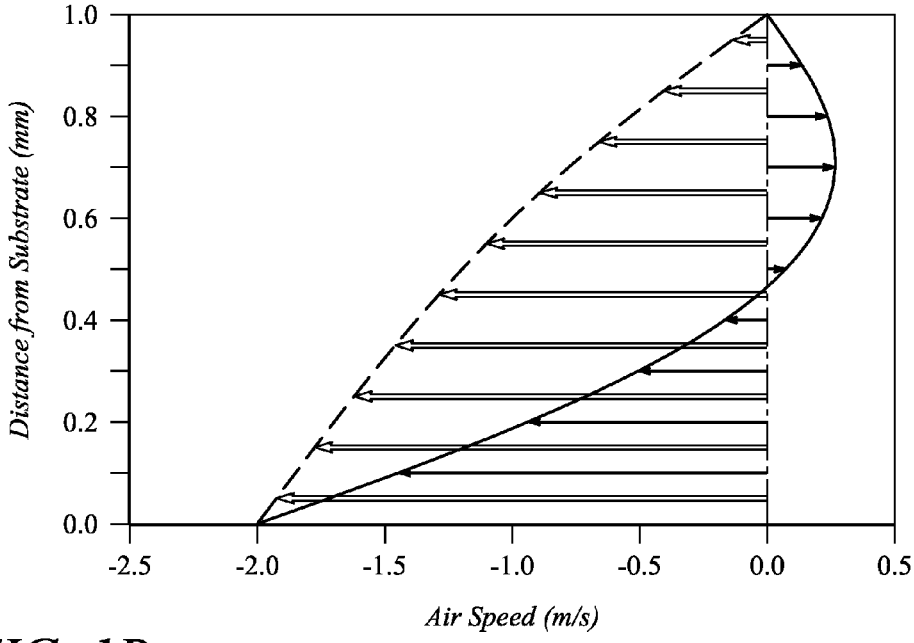
FIG. 1B illustrates a graph that compares velocity profiles with and without a boundary layer control apparatus on the inkjet printhead, according to an embodiment of the present invention.

FIG. 1B illustrates a graph that compares velocity profiles with the boundary layer control apparatus on an inkjet printhead, according to an embodiment of the present invention and without the apparatus. For the case where there is no control of the boundary layer, there is an expected, substantially linear profile, as depicted by a dashed line. For some embodiments of the present invention that include control of the boundary layer at the leading edge of the inkjet printhead, the resulting profile is not linear, as depicted by a solid line. The velocity profile is taken for a position 1 mm downstream from a trailing end of the boundary layer control apparatus. It should be noted that where there is no control of the boundary layer, the ink droplet and the tail of the ink droplet may be subject to speeds as high as 1 m/s during the first half of their flight from a nozzle opening. However, when control of the boundary layer is included in accordance with the embodiments of the present invention, the air speed only reach about 0.2 m/s, which is a 5× reduction in drag forces as a result of the boundary layer control apparatus, according to some embodiments. Also illustrated for the control of boundary layer case, is a reverse flow eddy or vortex that occurs between about 0.5 mm and 1.0 mm distance which corresponds to the low pressure zone 104 surrounding the nozzle opening.

Referring back to FIG. 1A, an embodiment of the boundary layer control structure 140 comprises a baffle 140 that is attached to the side 112 of the housing 110 between the nozzle opening 122 and the leading edge 114 of the housing 110. In such embodiments, the baffle 140 extends into the gap 102 except for a space 106 between the baffle 140 and the imaging substrate 130. The baffle 140 is configured to divert a portion of the air flow of the boundary layer 136 away from at least a portion of a droplet path from the nozzle opening 122 to the imaging substrate 130. In other words, the baffle 140 is configured to break the boundary layer 136 to keep a portion of boundary layer away from the gap 102. The space 106 between the baffle 140 and the imaging substrate 130 may range from about 50 microns to about 500 microns, in some embodiments.

Figure 1C:
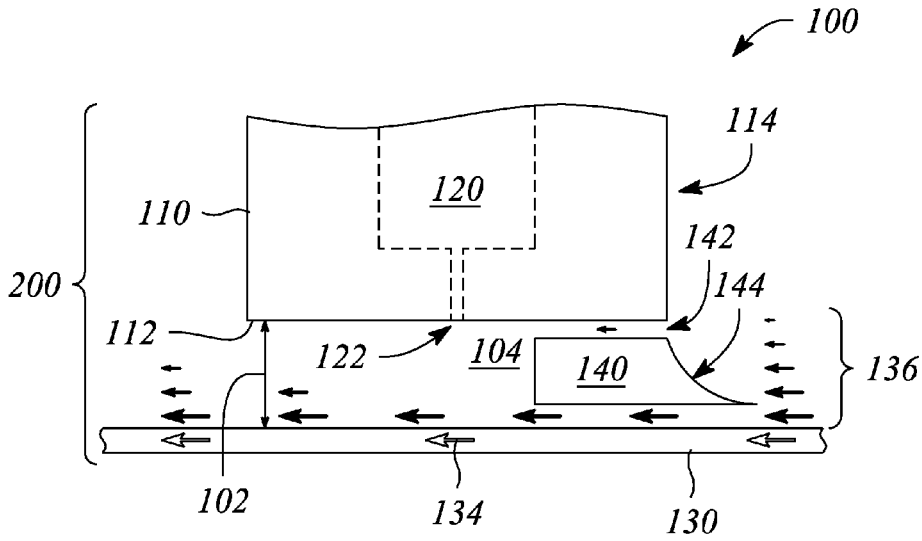
FIG. 1C illustrates a side view of an inkjet printhead having a boundary layer control apparatus of an inkjet printing system, according to another embodiment of the present invention.

FIG. 1C illustrates a side view of an inkjet printhead 100 of an inkjet printing system 200 according to another embodiment of the present invention. In the embodiment illustrated in FIG. 1C, the boundary layer control structure 140 is a baffle that comprises one or both of a flow-through channel 142 in a face of the baffle 140 adjacent to the side 112 of the housing 110 and a concave surface 144 at a leading end of the baffle 140. Note that the side view in FIG. 1C ordinarily would not show the channel 142 since it would not be visible from this view. However, the channel 142 is illustrated from this side view for simplicity of illustration herein. Moreover, FIG. 1C illustrates both of these features of the baffle 140 for simplicity of discussion only, since either feature (i.e., the channel 142 or the concave surface 144) alone may be present in accordance with some embodiments.

The flow-through channel 142 disposed between an upper portion of the baffle 140 is configured to provide a bleed passage for a small amount of the boundary layer 136 air flow to flow through into the low pressure zone 104 in order to reduce any recirculation flow in the low pressure zone 104. In some embodiments, the bleed passage provided by the channel 142 may prevent air flow recirculation in the zone 104. For example, the small amount of the boundary layer 136 air flow that is allowed to flow into the low pressure zone 104 through the flow-through channel 142 may be established to approximately counteract or substantially negate the reverse flow (or recirculation flow) illustrated in FIG. 1B.

In some embodiments, the concave surface 144 on the leading end of the baffle 140 is configured to break the boundary layer 136 (or split the air flow of the boundary layer) such that most of the air flow moves up and away from the inkjet printhead 100 with a small amount of the boundary layer 136 entering the gap 102 through the space 106 between a lower portion of the baffle and the imaging substrate 130. In some embodiments where the baffle 140 includes both the flow-through channel 142 and the concave surface 144, the concave surface 144 is configured to also divert an amount of the higher momentum air of the boundary layer 136 towards the channel 142.

Figure 2A:
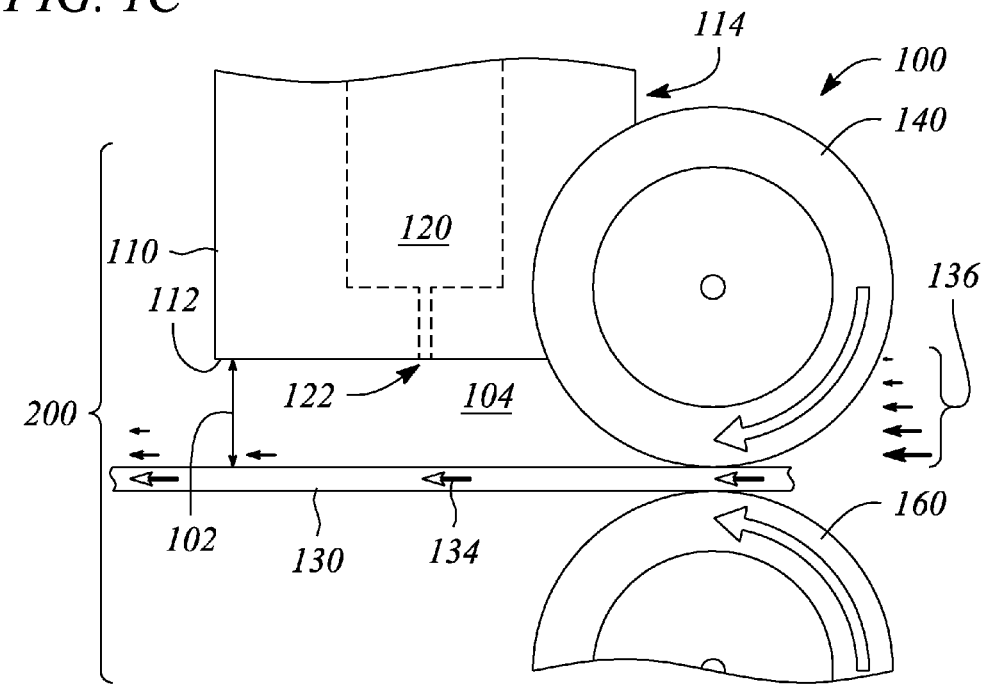
FIG. 2A illustrates a side view of an inkjet printhead having a boundary layer control apparatus of an inkjet printing system, according to another embodiment of the present invention.

FIG. 2A illustrates a side view of an inkjet printhead 100 having a roller as a boundary layer control apparatus 140 of an inkjet printing system 200, according to another embodiment of the present invention. The roller 140 is attached near the leading edge 114 of the housing 110. In some embodiments, the roller 140 is attached directly to the housing 110 at the leading edge 114. In other embodiments, the roller 140 is indirectly attached to the housing 110 adjacent to the leading edge 114. For example, the roller 140 may connected to a writing head assembly of an inkjet printer through two shaft edges or may be connected to a press frame/chassis of the inkjet printer similar to the way an inkjet printhead is mounted thereto.

As illustrated, the roller 140 is configured to contact a surface of the imaging substrate 130 and rotate both on the imaging substrate 130 and in the direction of movement 134 of the imaging substrate 130. As such, the boundary layer 136 is substantially obstructed from entering the gap 102. A boundary layer may develop downstream of the roller. However, the downstream boundary layer does not start to develop until after the vicinity of a droplet path (e.g., adjacent to a trailing edge of the housing 110), according to some embodiments of the present invention. The roller 140 illustrated in FIG. 2A is sometimes referred to as 'contact roller 140' herein to distinguish from other embodiments described below with respect to FIG. 2B.

In some embodiments, the roller 140 is made from a rubber material. In some embodiments, the roller 140 has a diameter that ranges from about 5 mm to about 20 mm. For example, the roller 140 may be a 12 mm roller in some embodiments. In some embodiments, a smaller diameter roller 140 may provide less downstream boundary layer development in the gap 102. Applications for the roller 140, which is configured to contact the imaging substrate 130, include printing on paper-like media with poor dimensional stability, for example. In some embodiments, such a contact roller 140 may be placed near the leading edge ahead of each ink color where intermediate partial drying or fixing of the deposited ink is used, for example.

Figure 2B:
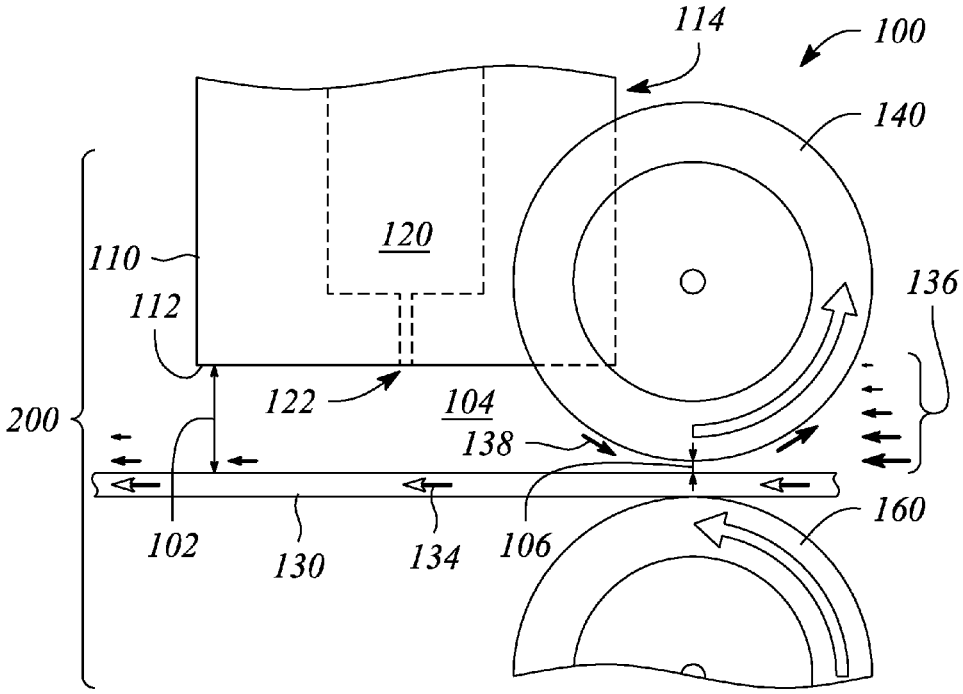
FIG. 2B illustrates a side view of an inkjet printhead having a boundary layer control apparatus of an inkjet printing system, according to another embodiment of the present invention.

FIG. 2B illustrates a side view of an inkjet printhead 100 having a reverse roller 140 as a boundary layer control apparatus 140 in an inkjet printing system 200, according to another embodiment of the present invention. The reverse roller 140 is attached near the leading edge 114 of the housing 110. In some embodiments, the reverse roller 140 is attached directly to the housing 110 at the leading edge 114. In other embodiments, the reverse roller 140 is indirectly attached to the housing 110 adjacent to the leading edge 114. For example, the reverse roller 140 may be attached similar to the examples provided above for the contact roller 140. The reverse roller 140 is called a 'reverse' roller because the roller 140 is configured to rotate in a reverse direction to the direction of movement 134 of the imaging substrate 130. The reverse direction of movement acts to disrupt the boundary layer 136 in the vicinity of a droplet path from the nozzle opening 122 to the imaging substrate 130. In particular, the reverse roller 140 may create a reverse boundary layer (illustrated as arrows 138) that moves in opposition to the boundary layer 136.

The reverse roller 140 is further configured to rotate above the imaging substrate at a distance away from the imaging substrate 130 that provides a space 106 between the reverse roller 140 and the imaging substrate 130. In some embodiments, the space 106 facilitates a path for the reverse boundary layer 138 mentioned above to counteract the boundary layer 136. In some embodiments, the space 106 ranges from about 50 microns to about 500 microns. In some embodiments, a reverse roller 140 is applicable to imaging substrates 130 that are non-porous such that the space 106 provides for a previously deposited thin image on the imaging substrate 130 to move through the space 106 undisturbed.

Figure 2C:
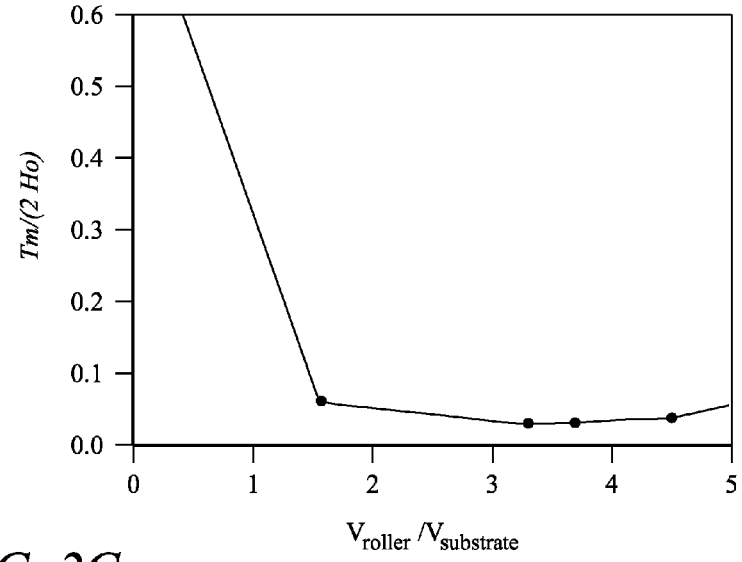
FIG. 2C illustrates a graph of non-dimensional experimental data for an operational boundary layer control apparatus illustrated in FIG. 2B, according to an embodiment of the present invention.

FIG. 2C illustrates a graph of non-dimensional experimental data for the reverse roller 140 that is illustrated in FIG. 2B (in operation) and a typical fluid, according to an embodiment of the present invention. The graph provides reverse roller metering effect versus speed ratio. An effective thickness Tm of a fluid layer (e.g., the beginning of a boundary layer) that goes through the space 106 (normalized with the space 106 (2Ho) between the reverse roller 140 and the imaging substrate 130) is graphed against a ratio of speed $V_{roller}$ of the reverse roller 140 to speed $V_{substrate}$ of the imaging substrate 130.

In some embodiments, the reverse roller 140 embodiment may cut the boundary layer thickness down to 50 microns, for example, with the reverse roller 140 being more than 50 microns away from the substrate 130 (i.e., the space 106>50 microns). For example, the reverse roller 140 embodiment may cut the boundary layer thickness down to 50 microns with a 1000 microns space 106 without a risk of touching the substrate 130, for example when the substrate is buckled paper. As illustrated in FIG. 2C, the thickness Tm of the boundary layer can be reduced when the reverse roller 140 rotates at any speed as compared to simply having a stationary surface to break the boundary layer. Using an operating condition at which $V_{roller}/V_{substrate}=2$, for example, the space 106 may range from about 100 microns to about 500 microns, in some embodiments. In other words, when the reverse roller 140 is rotated at 2 times the speed of the imaging substrate 130, the reverse roller 140 may appear as a stationary wall spaced only about 10 microns to about 25 microns away from the imaging substrate 130 even though the reverse roller 140 is spaced (space 106) about 200 microns to about 500 microns away.

Figure 3:
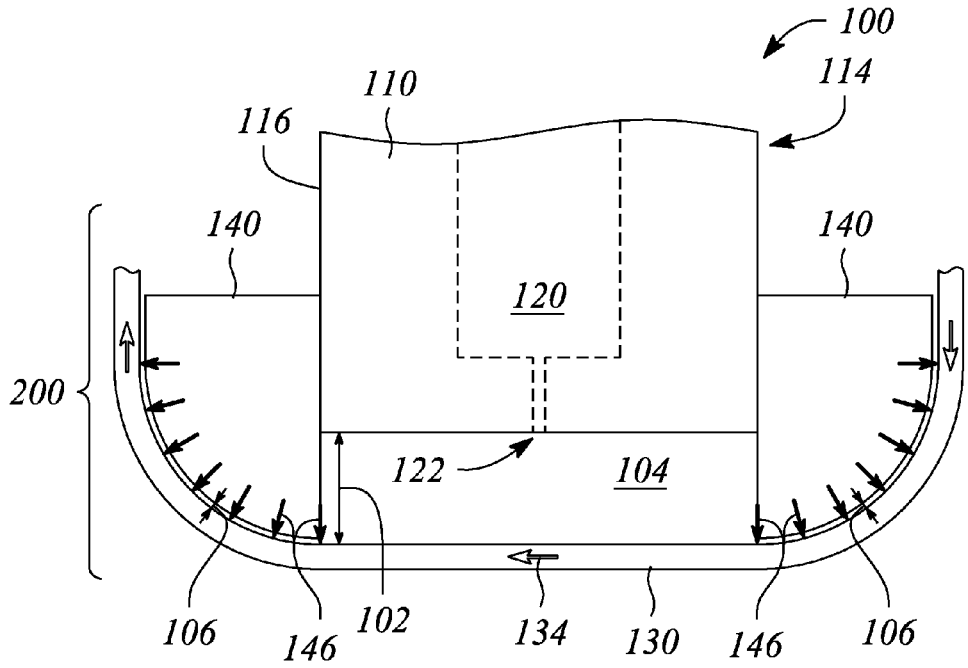
FIG. 3 illustrates a side view of an inkjet printhead having a boundary layer control apparatus of an inkjet printing system, according to another embodiment of the present invention.

FIG. 3 illustrates a side view of an inkjet printhead 100 having air bars 140 as a boundary layer control apparatus 140 of an inkjet printing system 200, according to another embodiment of the present invention. As illustrated in FIG. 3, the boundary layer control apparatus 140 comprises a first air bar 140 at the leading edge 114 of the housing 110. In some embodiments, the boundary layer control apparatus 140 further comprises a second air bar 140 at a trailing edge 116 of the housing 110. The pair of air bars 140 is configured to provide pressurized air in cylindrical profiles toward the imaging substrate 130 and away from the nozzle opening 122, as illustrated with radially extending arrows 146 in FIG. 3. The air bars 140 maintain the gap 102 between the nozzle opening 122 and the imaging substrate 130.

Moreover, the air bars are configured to each create a space 106 between the cylindrical profiles of the air bars 140 and the imaging substrate 130 that provide an inlet and an outlet to the vicinity surrounding the nozzle opening 122 in the gap 102. The spaces 106 are narrower than the gap 102. In some embodiments, the spaces 106 may range from about 25 microns to about 50 microns in thickness, for example. As such, the imaging substrate 130 rides on a thin cushion of air in the spaces 106.

In some embodiments, the pressurized air in the spaces 106 may break or substantially eliminate the boundary layer 136 in the gap 102 to avoid adverse effects of the boundary layer in the vicinity of a droplet path. In some embodiments, the air bars 140 may be configured with sufficiently symmetric flow 146 to create a stagnation zone in the gap 102 surrounding the nozzle opening 122 of the inkjet pen 120.

In some embodiments, the inkjet printhead 100 comprising the pair of air bars 140 is applicable to printing systems that deposit ink on imaging substrates that are porous, like paper, which lacks good dimensional stability. In a printing environment, some embodiments of the inkjet printhead 100 include air bars 140 that are configured such that the spaces 106 may allow minimal disturbance to previous deposited images.

The inkjet printing system 200 is illustrated in FIGS. 1A, 1C, 2A, 2B and 3, according to various embodiments of the present invention. The printing system 200 comprises any of means 140 for controlling a boundary layer in the embodiments of the inkjet printhead 100 described above and further comprises the imaging substrate 130. In some embodiments, the imaging substrate 130 is a blanket intermediate member that transfers the ink from its receiving surface to a surface of a print media, such as that used in offset inkjet printing. In other embodiments, the imaging substrate 130 is the print media. The print media includes, but is not limited to, various paper materials, various plastic materials and various cloth materials.

For example, the paper material may be coated or uncoated; the plastic material includes, but is not limited to, poly vinyl chloride (PVC) plastic; and the cloth material includes, but is not limited to, cotton and polyester. In some embodiments, the inkjet printing system 200 is a commercial digital printer. In some of these embodiments, the inkjet printing system 200 is an offset commercial digital printer. In some embodiments, the inkjet printing system 200 is a high speed inkjet printer. In some of these embodiments, the inkjet printing system 200 is a single pass, commercial digital printer that includes, but is not limited to, offset printing. In some embodiments that include a roller 140 (FIGS. 2A and 2B) as the boundary layer control apparatus, the printing system 200 further comprises a counter-roller 160 located adjacent to an opposite surface of the imaging substrate 130 from the roller 140. The counter-roller 160 is substantially vertically aligned with the roller 140 and rotates on and in the direction of movement 134 of the imaging substrate 130.

Figure 4:
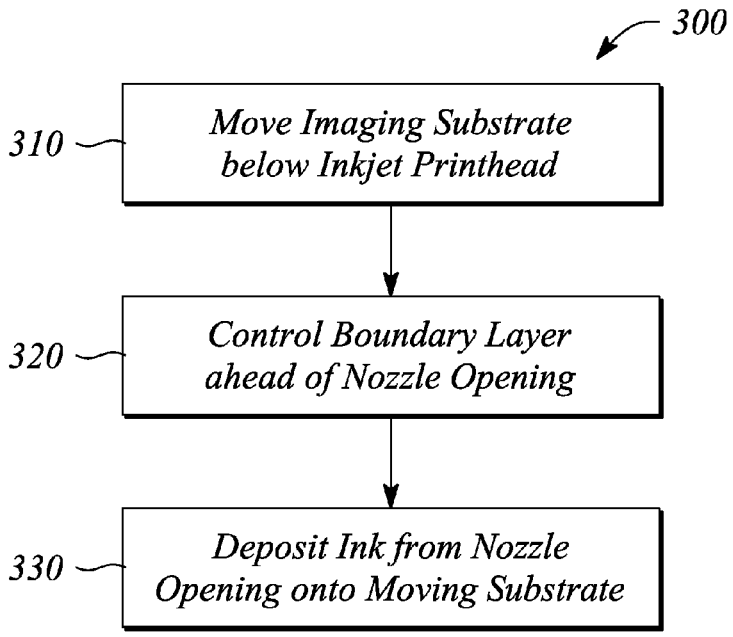
FIG. 4 illustrates a flow chart of a method of inkjet printing, according to an embodiment of the present invention.

FIG. 4 illustrates a flow chart of a method 300 of inkjet printing, according to an embodiment of the present invention. The method 300 of inkjet printing comprises moving 310 a substrate below an inkjet printhead at a speed that creates a boundary layer of air flow in a gap between the substrate and the printhead. In some embodiments, the imaging substrate moves 310 at a speed ranging from about 1 meter per second (m/s) to about 10 m/s, which depends in part on the type of inkjet printing system used. Moreover, the inkjet printhead may move relative to the substrate depending on the inkjet printing system. In some embodiments, the speed of the imaging substrate during inkjet printing ranges from about 2 m/s to about 5 m/s. In some embodiments of high speed inkjet printing, the speed of the imaging substrate is greater than 2 m/s. The boundary layer includes aerodynamic drag forces and shear forces associated with a relative motion between the inkjet printhead and the substrate. The substrate may be a blanket intermediate member that transfers a pattern of ink to a print media or the substrate may be the print media itself. The print media includes, but is not limited to, paper materials, cloth materials and plastic materials.

The method 300 of high speed inkjet printing further comprises controlling 320 the boundary layer ahead of a nozzle opening in the inkjet printhead. The inkjet printhead supports an inkjet pen which has the nozzle opening in a side of the printhead that faces the moving substrate. The nozzle opening is spaced from the moving substrate by the gap. Controlling 320 the boundary layer comprises incorporating a boundary layer control structure adjacent to the inkjet printhead. The structure is incorporated by locating the structure near a leading edge of the printhead prior to moving 310 the substrate. The leading edge is ahead of the nozzle opening relative to a direction of movement of the substrate. In some embodiments, the structure is directly attached to the inkjet printhead near the leading edge. In other embodiments, the structure is indirectly attached to the inkjet printhead adjacent to the leading edge. The structure is located adjacent to but laterally spaced from a nozzle opening of the inkjet pen and the structure extends into the gap between the nozzle opening and an imaging substrate to restrict or disrupt the boundary layer. In some embodiments, the gap between the nozzle opening of the inkjet printhead and the imaging substrate is about 1 mm.

The method 300 of high speed inkjet printing further comprises depositing 330 an ink from the nozzle opening onto a surface of the moving substrate Ink deposition onto the surface of the moving substrate facilitates the inkjet printing. During deposition 330 of the ink, the boundary layer control structure controls the boundary layer by restricting or disrupting the boundary layer in the gap in a vicinity of at least a portion of a droplet path of the ink.

The boundary layer in the gap associated with the moving imaging substrate may be understood as substantially linear Couette flow. The components of Couette flow have an affect on an ink droplet as it traverses the gap from the nozzle opening to the surface of the imaging substrate. Such components of the Couette flow may subject the ink droplets to forces that may break apart the droplets during flight. At high substrate speeds, for a high throughput single pass inkjet printing system, the droplet is exposed to high aerodynamic drag forces and high shear forces. The wider the gap between the nozzle opening in the inkjet printhead and the imaging substrate, the longer the ink droplet is exposed to these forces. As such, the ink droplet is more likely to be broken into parts, known as 'satellites' and 'aerosols'. In some embodiments, it may take up to a 1 mm distance for cohesion forces of the ink droplet to recombine the ink droplet before the ink droplet contacts the moving substrate in a predetermined location.

The boundary layer control structure incorporated with the inkjet printhead of the inkjet printing system and method of inkjet printing according to the various embodiments herein reduces the aerodynamic drag forces and shear forces to which the ink droplets are subjected in the gap. The boundary layer control structure that is incorporated comprises one of a baffle, a roller, and a reverse roller adjacent to the leading edge and air bars on the leading edge and a trailing edge of the housing. With respect to the baffle, the reverse roller and the air bars, a space is provided between each of these structures and the imaging substrate in addition to maintaining the gap. The additional space is narrower than the gap. Moreover, the reverse roller rotates in a direction opposite to the direction of movement of the imaging substrate. With respect to the roller, no space is provided and the roller rotates on the moving imaging substrate in the direction of movement of the imaging substrate. As such, an inkjet printing system that incorporates the roller as the boundary layer control apparatus may include the roller before each color separation that also includes intermediate partial drying or fixing between ink colors.

With respect to the baffle, controlling 320 the boundary layer comprises diverting at least a portion of the boundary layer away from the gap or in other words, breaking the boundary layer. In some embodiments, diverting at least a portion of the boundary layer or breaking the boundary layer comprises splitting the air flow of the boundary layer, both a portion of the air flow into a flow-through channel at an upper portion of the baffle and a portion of the air flow into the space below the baffle to divert the boundary layer away from at least a portion of the droplet path.

With respect to the roller, controlling 320 the boundary layer comprises obstructing the boundary layer from entering the gap in the vicinity of the droplet path. With respect to the reverse roller, controlling 320 the boundary layer comprises counteracting the boundary layer with a reverse boundary layer in the space. With respect to the air bars, controlling 320 the boundary layer comprises applying pressurized air in cylindrical profiles from the air bars toward the substrate and away from the droplet path to substantially eliminate the boundary layer in the gap. In some embodiments, the boundary layer control structure is the same as any of the embodiments of the boundary layer control apparatus 140 described above for the inkjet printhead 100 or the inkjet printing system 200 embodiments of the present invention.

Thus, there have been described embodiments of an inkjet printhead, an inkjet printing system and a method of inkjet printing that employ a boundary layer control apparatus to control the boundary layer surrounding a nozzle opening of an inkjet pen. It should be understood that the above-described embodiments are merely illustrative of some of the many specific embodiments that represent the principles of the present invention. Clearly, those skilled in the art can readily devise numerous other arrangements without departing from the scope of the present invention as defined by the following claims.

What is claimed is:

1. An inkjet printhead comprising:

an inkjet pen supported by a housing, the inkjet pen having a nozzle opening a side of the housing, the inkjet pen being configured such that the nozzle opening both faces a substrate and is spaced from the substrate by a gap; and a structure adjacent to the nozzle opening supported at a leading edge of the housing, the leading edge being ahead of the nozzle opening relative to a direction of movement of the substrate, the structure being configured to extend into the gap at the leading edge to control a boundary layer of air flow in the gap surrounding the nozzle opening, wherein the structure comprises a baffle that is attached to the side of the housing between the nozzle opening and the leading edge, the baffle being configured to divert the boundary layer away from at least a portion of a droplet path from the nozzle opening, and wherein the baffle comprises a flow-through channel adjacent to the side of the housing, the flow-through channel being configured to reduce recirculation air flow in the gap surrounding the nozzle opening.

2. The inkjet printhead of claim 1, wherein the baffle further comprises a concave surface at a leading end of the baffle, the concave surface being configured to split the air flow of the boundary layer both into the channel at an upper portion of the baffle and into a space below the baffle, the space being narrower than the gap.

3. An inkjet printing system comprising:

an inkjet printhead; and a substrate spaced from the inkjet printhead and configured to move at a substrate speed, wherein the inkjet printhead comprises:

an inkjet pen supported in a housing, the inkjet pen having a nozzle opening in a side of the housing, the side both facing a surface of the substrate and being spaced from the substrate by a gap, wherein movement of the substrate is to create a boundary layer of air flow in the gap that is greatest directly adjacent to the surface of the substrate facing the nozzle opening; and means for controlling the boundary layer of air flow in the gap, the means for controlling being located a distance from the nozzle opening and attached near a leading edge of the housing, the leading edge being ahead of the nozzle opening relative to a direction of the substrate movement, a square root of the distance between the means for controlling and the nozzle opening being proportional to a thickness of the boundary layer times a square root of the substrate speed, the means for controlling extending into the gap to disrupt the boundary layer in a vicinity of a droplet path from the nozzle opening.

4. The inkjet printing system of claim 3, wherein the means for controlling is a boundary layer control apparatus comprising a baffle attached to the side of the housing between the nozzle opening and the leading edge, the baffle comprising one or both of a concave surface at a leading end of the baffle and a flow-through channel in a surface of the baffle adjacent to the side of the housing, the baffle being configured to divert the air flow of the boundary layer at least into a space between the baffle and the substrate, the space being narrower than the gap.

5. The inkjet printing system of claim 3, wherein the means for controlling is a boundary layer control apparatus comprising a roller, and wherein the inkjet printing system further comprises a counter-roller located adjacent to an opposite surface of the substrate, the counter-roller being effectively vertically aligned with the roller, the counter-roller being configured to rotate on the opposite surface of the substrate in the direction of substrate movement.

6. The inkjet printing system of claim 5, wherein the roller is configured to rotate in contact with a surface of the substrate in the direction of the substrate, the roller being configured to obstruct the boundary layer.

7. The inkjet printing system of claim 5, wherein the roller is configured to rotate in a reverse direction to the substrate movement direction without contacting a surface of the substrate, the roller being configured to counteract the boundary layer with a reverse boundary layer.

8. The inkjet printing system of claim 3, wherein the means for controlling is a boundary layer control apparatus comprising a pair of air bars attached to both the leading edge and a trailing edge of the housing, the nozzle opening being between the pair of air bars in the gap, the air bars being configured to provide pressurized air in cylindrical profiles toward the substrate and away from the nozzle opening to substantially eliminate the boundary layer, the pressurized air creating a space between the air bars and the substrate, the space being narrower than the gap.

9. The inkjet printing system of claim 3, wherein the printing system is an offset inkjet printing system, the substrate being a blanket intermediate member configured to transfer a pattern of ink from the inkjet printhead to a print-receiving media.

10. The inkjet printing system of claim 3, wherein the means for controlling is a structure that comprises a roller, the roller being configured to leave a space between the roller and the substrate surface, the roller further being configured to rotate in a reverse direction to the direction that the substrate is to move to counteract the boundary layer in the space ahead of a droplet path from the nozzle opening.

11. A method of inkjet printing comprising:

moving a substrate below an inkjet printhead at a substrate speed, the movement creating a boundary layer of air flow in a gap between the substrate and the inkjet printhead that is greatest directly adjacent to a surface of the substrate facing the inkjet printhead;

controlling the boundary layer of air flow ahead of a nozzle opening in the inkjet printhead, wherein controlling the boundary layer comprises incorporating a structure a distance from the nozzle opening near a leading edge of the inkjet printhead prior to moving the substrate, the leading edge being ahead of the nozzle opening relative to a direction of the substrate movement, the structure extending into the gap, a square root of the distance between the structure and the nozzle opening being proportional to a thickness of the boundary layer times a square root of the substrate speed; and depositing an ink from the nozzle opening onto the surface of the moving substrate, the structure disrupting the boundary layer in the gap in a vicinity of at least a portion of a droplet path of the ink.

12. The method of inkjet printing of claim 11, wherein incorporating a structure comprises attaching a baffle to a side of the inkjet printhead that faces the substrate, and wherein controlling a boundary layer further comprises diverting the boundary layer away from at least a portion of the droplet path with the baffle.

13. The method of inkjet printing of claim 12, wherein the baffle comprises a flow-through channel in an upper portion adjacent to the side of the inkjet printhead and a concave surface on a leading end of the baffle, and wherein diverting the boundary layer comprises splitting the air flow of the boundary layer both into the flow-through channel at the upper portion of the baffle and into a space below the baffle that is narrower than the gap.

14. The method of inkjet printing of claim 11, wherein incorporating a structure comprises attaching a roller adjacent to the leading edge of the inkjet printhead, the roller rotating both in a direction of the moving substrate and on a surface of the moving substrate, and wherein controlling a boundary layer further comprises obstructing the boundary layer from the droplet path with the roller.

15. The method of inkjet printing of claim 11, wherein incorporating a structure comprises attaching a reverse roller adjacent to the leading edge of the inkjet printhead such that a space is left between the reverse roller and the substrate, the reverse roller rotating in a reverse direction to a direction of the moving substrate to create a reverse boundary layer, and wherein controlling a boundary layer further comprises counteracting the boundary layer with the reverse boundary layer in the space.

16. The method of inkjet printing of claim 11, wherein incorporating a structure comprises attaching a first air bar to the leading edge of the inkjet printhead and attaching a second air bar to a trailing edge of the inkjet printhead, and wherein controlling a boundary layer further comprises applying pressurized air in cylindrical profiles from the air bars toward the substrate and away from the droplet path to substantially eliminate the boundary layer in the gap.

17. The inkjet printing system of claim 3, wherein the means for controlling is a structure that comprises a roller, the roller being configured to rotate both in the direction that the substrate is to move and on the substrate surface, such that the boundary layer is substantially obstructed from a droplet path from the nozzle opening.

* * * * *

UNITED STATES PATENT AND TRADEMARK OFFICE

CERTIFICATE OF CORRECTION

PATENT NO. : 8,596,742 B2
APPLICATION NO. : 12/694155
DATED : December 3, 2013
INVENTOR(S) : Napoleon J. Leoni et al.

It is certified that error appears in the above-identified patent and that said Letters Patent is hereby corrected as shown below:

In the Claims

In column 9, line 53, in Claim 1, delete “opening” and insert -- opening in --, therefor.

Signed and Sealed this
Thirteenth Day of May, 2014

Michelle K. Lee

Michelle K. Lee
*Deputy Director of the United States Patent and Trademark Office*